United States Patent [19]

Janke et al.

[11] Patent Number: 4,689,965

[45] Date of Patent: Sep. 1, 1987

[54] ADAPTIVE DEFROST CONTROL FOR A REFRIGERATOR

[75] Inventors: Donald E. Janke, Benton Township, Berrien County; William J. Linstromberg, Lincoln Township, Berrien County, both of Mich.

[73] Assignee: Whirlpool Corporation, Benton Harbor, Mich.

[21] Appl. No.: 814,216

[22] Filed: Dec. 27, 1985

[51] Int. Cl.[4] ..... F25D 21/06

[52] U.S. Cl. ..... 62/155; 62/156

[58] Field of Search ..... 62/155, 156, 140, 234

[56] References Cited

U.S. PATENT DOCUMENTS

| | | | |
|---|---|---|---|
| 3,335,576 | 8/1967 | Phillips | 62/156 |
| 4,156,350 | 5/1979 | Elliott et al. | 62/155 |
| 4,251,988 | 2/1981 | Allard et al. | 62/80 |
| 4,432,211 | 2/1984 | Oishi et al. | 62/155 |
| 4,481,785 | 11/1984 | Tershak et al. | 62/153 |
| 4,488,823 | 12/1984 | Baker | 374/170 |

*Primary Examiner*—Harry Tanner

*Attorney, Agent, or Firm*—Wood, Dalton, Phillips, Mason & Rowe

[57] ABSTRACT

An adaptive defrost control for a refrigeration device alternately operated in cooling and defrosting cycles includes means for detecting the rate of change of temperature of an evaporator of the refrigeration device during a defrosting cycle, means for determining the length of time the rate of change of evaporator temperature remains at substantially zero and means for establishing the duration of a subsequent cooling cycle in dependence upon the determined length of time. The determined length of time is indicative of the magnitude of the frost load that formed on the evaporator and the length of the next cooling cycle is adjusted in accordance therewith so that the magnitude of the frost load built up on the evaporator in subsequent cooling cycles is forced toward a value which increases the efficiency of the refrigeration device.

15 Claims, 6 Drawing Figures

ADAPTIVE DEFROST CONTROL FOR A REFRIGERATOR

BACKGROUND OF THE INVENTION

The present invention relates generally to controls for a refrigeration device, and more particularly to an adaptive defrost control for a refrigerator which varies the duration between defrosting cycles based upon the length of the time required to remove a frost load during the prior defrosting cycle.

Refrigeration controls are known wherein defrosting of an evaporator by defrosting apparatus is accomplished at periodic intervals. For example, Oishi et al U.S. Pat. No. 4,432,211 discloses a defrosting apparatus for removing frost deposited on a cooler of a refrigerator. The defrosting apparatus includes a defrosting heater which is periodically energized and is of the self-controlled type wherein the current through the heater is a function of the temperature thereof. The heater is de-energized at the end of a defrosting cycle by a control when the rate of change of current through the defrost heater exceeds a predetermined value.

A further type of defrost control is disclosed in Phillips U.S. Pat. No. 3,335,576. This defrost control utilizes a pair of thermistors which are disposed in heat transfer relationship with an evaporator coil of the refrigerator. When one of the thermistors senses a predetermined low temperature, a defrost cycle is initiated, which cycle is discontinued when the temperature sensed by the other thermistor reaches a predetermined high temperature.

A still further type of defrost control is disclosed in Allard et al U.S. Pat. No. 4,251,988. This defrost control is referred to as an "adaptive" defrost control since it establishes the time between succeeding defrosting cycles as a function of the length of time that the defrost heater was energized during the first defrosting cycle.

A more sophisticated type of adaptive defrost control is disclosed in Tershak et al U.S. Pat. No. 4,481,785, assigned to the assignee of the instant application. This adaptive defrost control varies the length of an interval between defrosting cycles in accordance with the number and duration of compartment door openings, the duration of a previous defrosting cycle as corrected by the temperature of the evaporator prior to defrost and the length of time the compressor has been energized.

Some of these prior types of controls rely upon the detection of the temperature of a component (such as an evaporator) by means of a thermistor. Various methods have been devised to determine the temperature to which a thermistor is exposed. For example, Baker U.S. Pat. No. 4,488,823, assigned to the assignee of the instant application, discloses a method wherein a capacitor is charged through a reference resistor and the length of time required to charge the capacitor to a predetermined level is measured to obtain a reference charge time. The capacitor is then discharged and subsequently charged through the thermistor whose temperature is to be determined. The length of time required to charge the capacitor to the predetermined level is again measured to obtain a temperature charge time. The temperature of the thermistor is determined by computing the difference between tween the reference charge time and the temperature charge time divided by the sum of the times.

SUMMARY OF THE INVENTION

In accordance with the present invention, an adaptive defrost control makes use of the latent heat of fusion properties of frost in order to accurately determine the magnitude of a frost load on an evaporator and varies the interval before the next defrosting cycle based upon such determination.

The instant control is particularly adapted for use in conjunction with a refrigeration device having cooling apparatus including an evaporator, defrosting apparatus for removing a frost load from the evaporator and means for energizing the defrosting apparatus at the end of a cooling cycle to initiate a defrosting cycle. The control includes means for detecting the rate of change of evaporator temperature during a defrosting cycle, means for determining the len9th of time the rate of change of evaporator temperature remains at a substantially zero value and means for establishing the duration of a subsequent cooling cycle in dependence upon the determined length of time.

The instant invention makes particular use of the unique properties of water. More particularly, it has long been known that water, when in its solid state as ice or frost, remains at a substantially constant 32° F. temperature while it is melting. This is due to the fact that the heat input during the melting interval, called the latent heat of fusion, melts the frost rather than raising the temperature of the frost.

The present invention utilizes this property to accurately and simply obtain an indication of the magnitude of a frost load by measuring the length of time it takes to remove the frost load. This is in turn accomplished by sensing the length of time the temperature of the evaporator remains at a constant level during a defrost cycle. In order to enhance this sensing process, the instant invention relies upon the detection of the rate of change of evaporator temperature, which detection can be generally more accurately accomplished than sensing of absolute temperature and which detection is not subject to variation due to the aging of components.

The evaporator temperature rate of change is detected by means for periodically sensing the evaporator temperature during the defrosting cycle. Means are included for comparing successive sensed temperatures for determining the rate of temperature change. The means for periodically sensing the evaporator temperature comprises a thermistor in heat-transfer association with the evaporator, a capacitor coupled in series with the thermistor, means for charging the capacitor through the thermistor and means for determining the length of time required to charge the capacitor to a certain level to thereby derive an indication of the evaporator temperature.

In a preferred embodiment, means are included for de-energizing the defrosting apparatus to terminate a defrosting cycle once the frost has been removed from the evaporator. Such means comprises means for determining when the rate of change of evaporator temperature rises above a certain value. Such means, in effect, is detecting an increased rate of change of evaporator temperature caused by heat input following the melting of the entire frost load.

The present invention improves the efficiency of the refrigeration device since the lengths of the cooling cycles can be accurately controlled under varying ambient conditions so that defrosting occurs.

Figure 2:
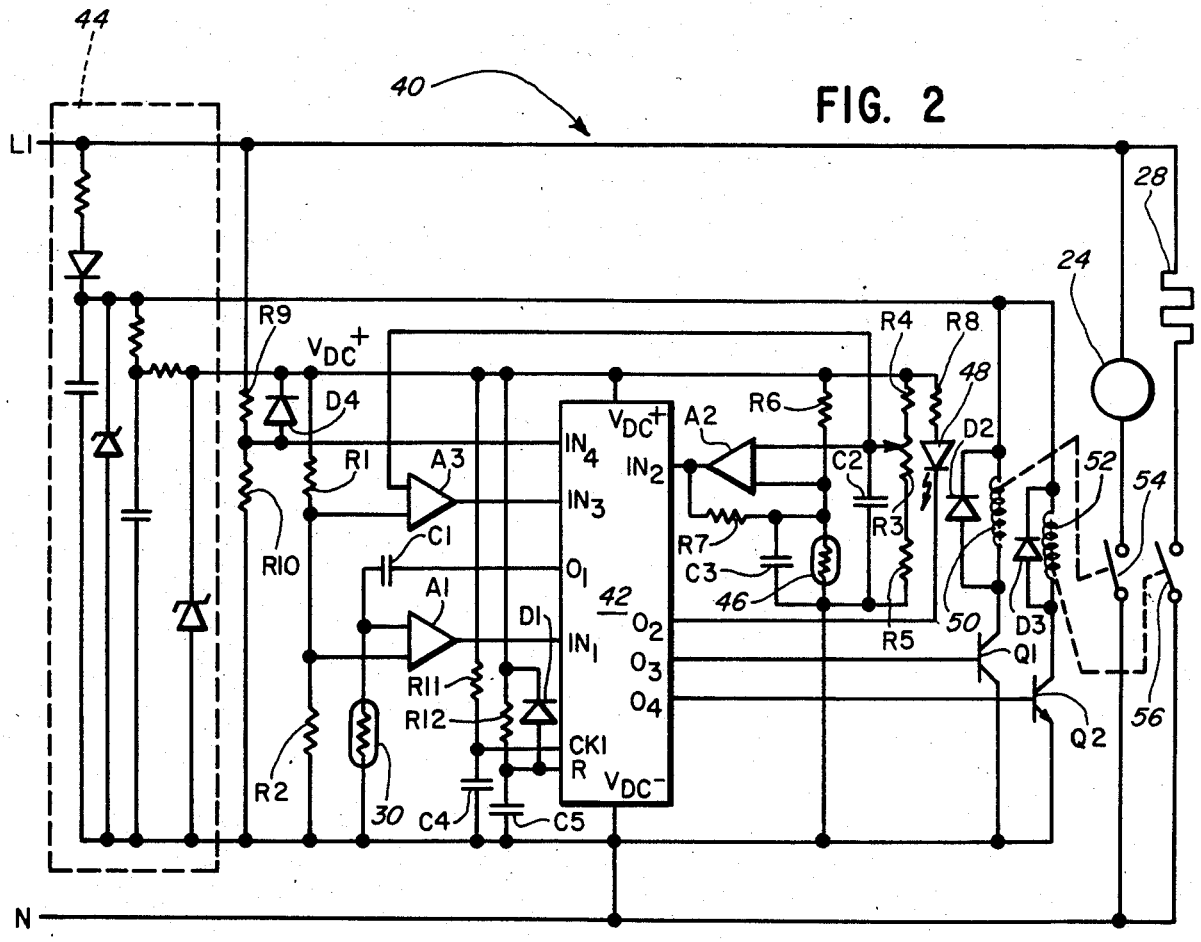
FIG. 2 is a schematic diagram of the control of the present invention.
Figure 4:
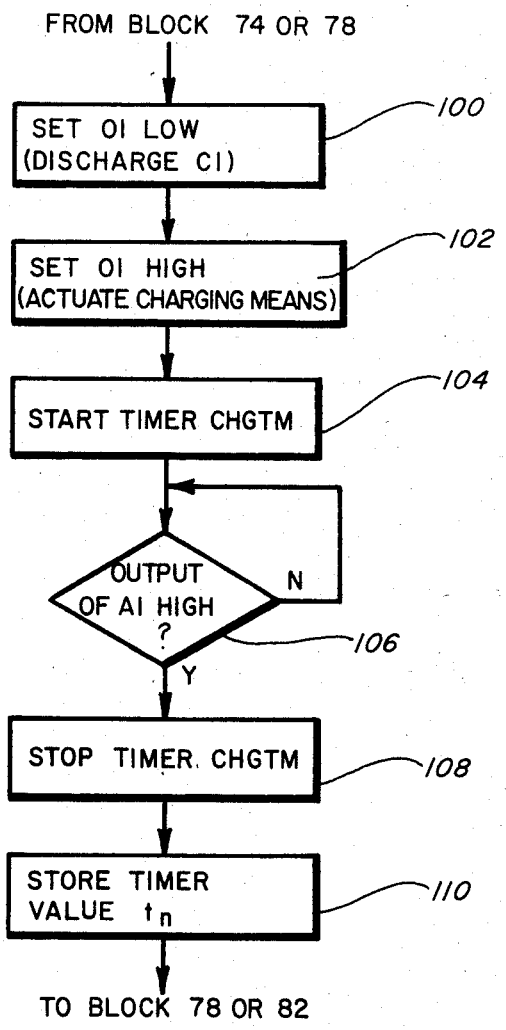
Figure 5:
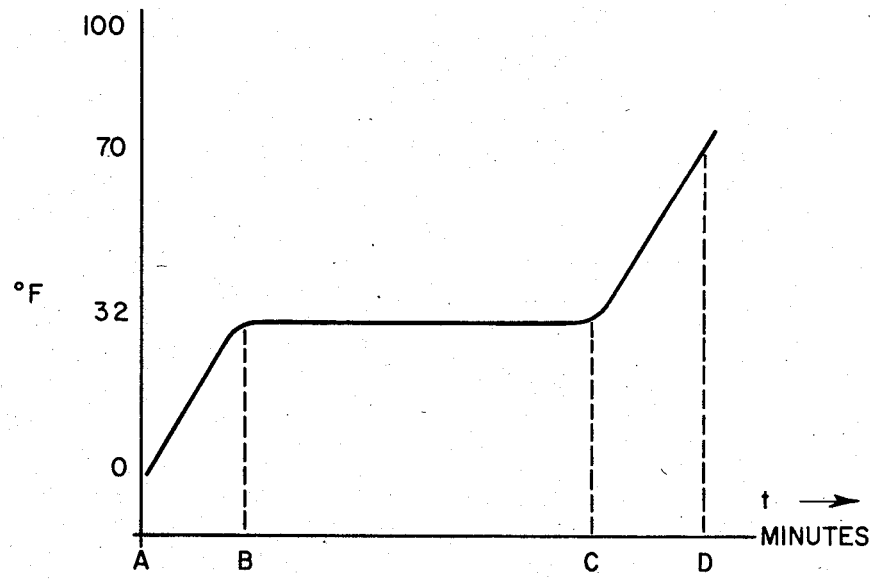

FIGS. *3a* and *3b* show a flow chart of the programming contained in the microcomputer shown in block diagram form in FIG. 2;

FIG. 4 is a further flow chart illustrating in greater detail the programming represented by the blocks 76 and 80 of FIG. *3a;* and FIG. 5 is a graph illustrating the relationship between evaporator temperature and time during a defrosting cycle.

DESCRIPTION OF THE PREFERRED EMBODIMENT

Figure 1:
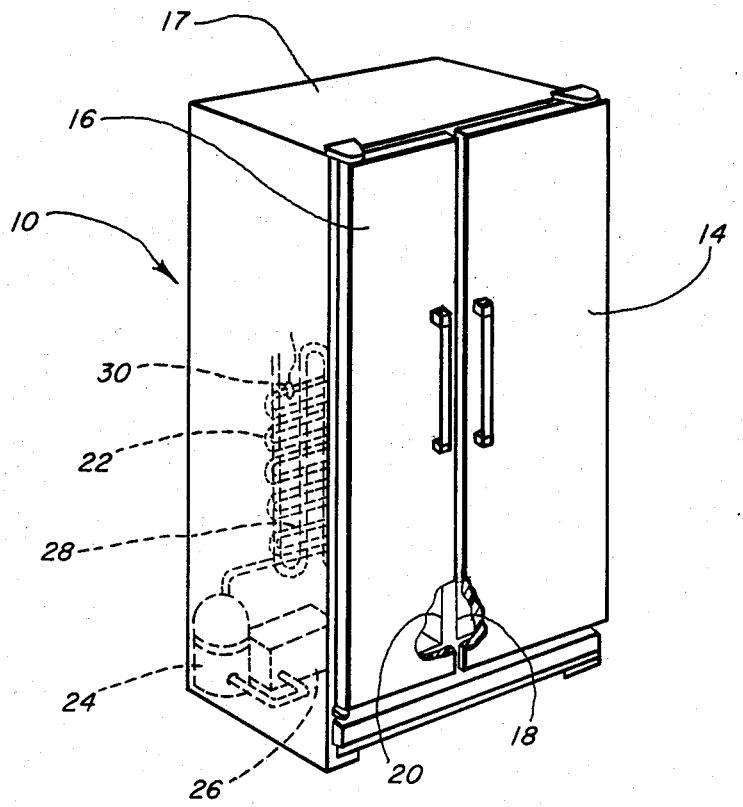
FIG. 1 is a perspective view with portions broken away illustrating a refrigeration device with which the instant invention may be used.

Referring now to FIG. 1, there is illustrated a refrigeration device in the form of a refrigerator 10 with which the present invention may be used. The refrigerator 10 includes a fresh food compartment door 14 and a freezer door 16 which, together with a cabinet 17, enclose a fresh food compartment 18 and a freezer compartment 20, respectively.

The compartments 18, 20 are refrigerated by passing refrigerated air therein which is cooled by cooling apparatus comprising an evaporator 22, a compressor 24 and a condenser 26 which are shown in phantom in FIG. 1. The cooling apparatus also includes a condenser fan, an evaporator fan and a header or accumulator (not shown), as is conventional.

The evaporator 22 is periodically defrosted by a defrost heater 28 operated by the control of the present invention. The defrost heater 28 may be of the ordinary resistive type or may be another type, as desired.

A temperature sensing device in the form of a thermistor 30 is disposed in heat-transfer relationship with the evaporator 22. More specifically, the thermistor 30 is mounted directly on the evaporator so as to sense the temperature thereof.

As noted more specifically below, one or more additional temperature sensors may be utilized to sense the temperature of one or both of the compartments 18, 20, if desired.

Referring now to FIG. 2, there is illustrated a schematic diagram of the control 40 according to the present invention. The control 40 may be disposed within the cabinet 17 or outside of the cabinet.

In general, the control comprises a microcomputer 42 which, in the preferred embodiment, comprises a COPS 422L chip manufactured by National Semiconductor Corp., together with temperature sensing circuitry and circuitry for controlling the compressor 24 and the defrost heater 28.

The various components shown in FIG. 2 receive DC voltage from a voltage regulator 44, shown in dotted lines in FIG. 2, which is in turn coupled to first and second AC voltage lines L1 and N.

Temperature sensing circuitry includes means for sensing the temperature of the evaporator 22 comprising a series combination of the thermistor 30 and a capacitor C1 coupled between a first output $O_1$ of the microcomputer 42 and the line N. The junction between the thermistor 30 and the capacitor C1 is coupled to a first input of an operational amplifier, or op amp A1, the output of which is coupled to a data input $IN_1$ of the microcomputer 42.

A second input of the op amp A1 is coupled to the junction between a pair of resistors R1 and R2 which are in turn coupled in series between a DC voltage $V_{DC}+$ and the voltage on the line N. The op amp A1 is therefore connected in a comparator configuration and generates an output signal that can assume one of two voltage levels depending upon the relative levels of the voltages at the inputs thereof.

A second op amp A2 includes an output which is coupled to a second data input $IN_2$ of the microcomputer 42. A first input of the op amp A2 is coupled to the wiper of a user-adjustable potentiometer R3 disposed within the cabinet 17 of the refrigerator. The potentiometer R3 which is a user-adjustable compartment temperature set point establishing means, as will be described in greater detail below, is coupled in series with resistors R4, R5 between the voltage $V_{DC}+$ and the voltage on the line N. A capacitor C2 is coupled between the wiper of the potentiometer R3 and the line N.

A second input of the op amp A2 is coupled to the junction between a resistor R6 and a thermistor 46 which is disposed within, for example, the fresh food compartment 18. The second input of the op amp A2 is also coupled by a capacitor C3 to the line N and through a resistor R7 to the input $IN_2$.

The circuitry comprising the op amp A2, the resistors R3–R7, the capacitors C2,C3 and the thermistor 46 in conjunction with the microcomputer 42 together comprise means for controlling the cooling apparatus of the refrigerator during cooling cycles of operation. This operation is described in greater detail below.

Also coupled to the wiper of the potentiometer R3 is a first input of an additional operational amplifier A3. A second input of the op amp A3 is coupled to the junction between the resistors R1 and R2 while an output of the op amp A3 is coupled to a third data input $IN_3$ of the microcomputer 42.

The input $IN_3$ of the microcomputer 42 is essentially an "on/off" control input controlled by the output of the op amp A3. The op amp A3 in turn develops an output to instruct microcomputer 42 to disable compressor 24 and heater 28 when the wiper of the compartment temperature set point potentiometer R3 is moved by a user to an extreme position. This allows a user to turn off refrigerator 10 when desired.

A series combination of a resistor R8 and a light emitting diode, or LED 48 is coupled between the voltage $V_{DC}+$ and an output $O_2$ of the microcomputer 42. The LED 48 is illuminated by the microcomputer 42 via the output $O_2$ and functions as a diagnostic light to indicate to a user the operating status of control 40 or another component of the refrigerator.

The microcomputer 42 includes additional outputs $O_3$ and $O_4$ which are coupled to transistors Q1 and Q2, respectively. The transistors Q1 and Q2 control the current through relay coils 50, 52 which are associated with and control relay contacts 54, 56, respectively. The relay contacts 54, 56 in turn control the energization of the compressor 24 and the defrost heater 28 respectively.

The microcomputer 42 includes a timing input $IN_4$ coupled to the junction between a pair of series-connected resistors R9 and R10 which are in turn coupled across the lines L1 and N. A diode D4 further couples input $IN_4$ to voltage $V_{DC}+$ to prevent the voltage present at this input from exceeding $V_{DC}+$.

A clock input CK1 of the microcomputer 42 is coupled to the junction between a resistor R11 and a capacitor C4. The resistor R11 and the capacitor C4 control the frequency of the internal clock of the microcomputer 42.

A power on reset function is provided by a resistor R12, a diode D1 and a capacitor C5 which are coupled to a reset input R of the microcomputer 42.

Figure 3A:
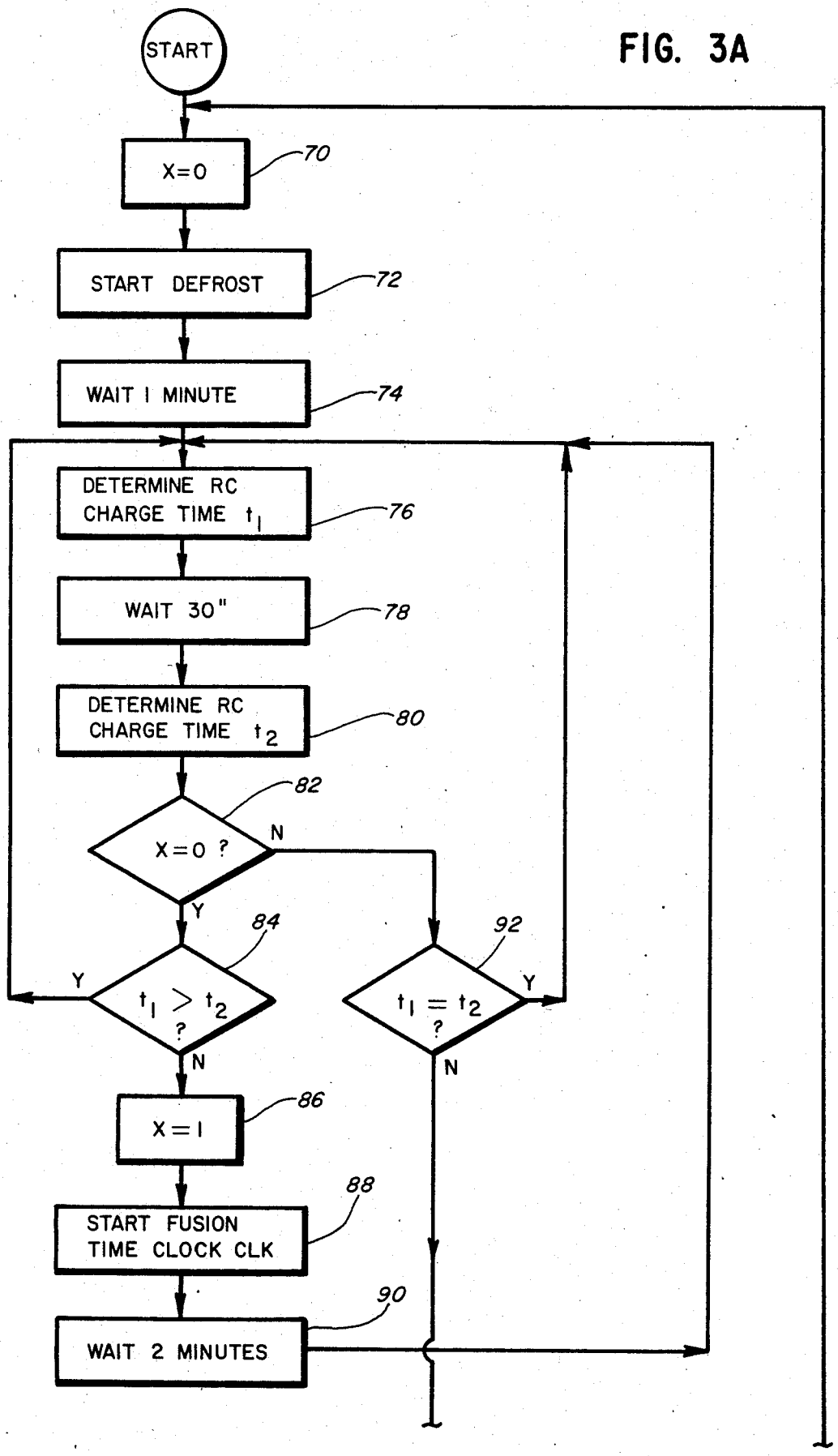
Figure 3B:
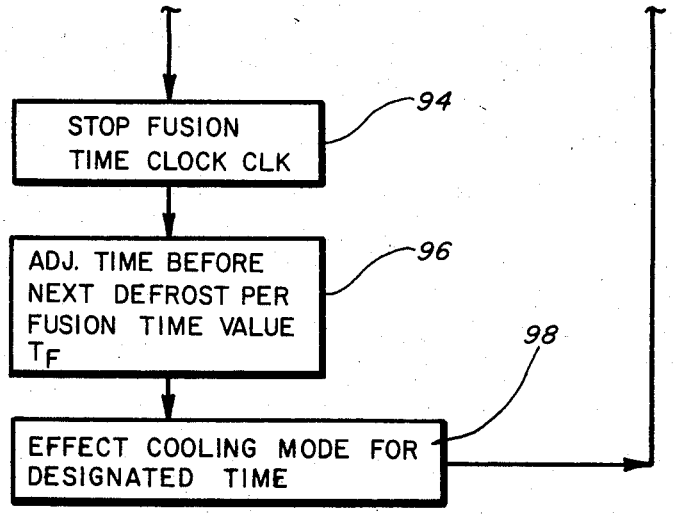

Referring now to FIGS. 3*a* and 3*b*, there is illustrated a flow chart of the programming contained within the microcomputer 42 for implementing the control of the instant invention.

The program begins at a block 70 which resets a flag X that is used to keep track of when the rate of change of temperature of the evaporator 22 is substanstantially zero. At this point in the program, it is assumed that a defrosting cycle has just begun (for example at time A in the graph of FIG. 5) and hence the rate of change of the evaporator temperature is at a positive value. Consequently, a zero is stored for this flag.

Control then passes to a block 72 which terminates a cooling cycle and initiates a defrosting cycle. This is accomplished by generating a low state signal at the output $O_3$ of the microcomputer 42, FIG. 2, and by generating a high state signal at the output $O_4$. These signals in turn de-energize the transistor Q1 and energize the transistor Q2 so that the relay contacts 54 are opened and the relay contacts 56 are closed. The compressor 24 is thereby disabled and the defrost heater 28 is energized to begin removal of a frost load on the evaporator 22.

After a delay of one minute interposed by a block 74, FIG. 3*a*, a block 76 determines the length of time $t_1$, required to charge the capacitor C1, FIG. 2, to a particular level through the evaporator temperature responsive thermistor 30. This is accomplished in the manner shown in FIG. 4 described in greater detail below. At this point, it is sufficient to note that the time $t_1$ required to charge the capacitor to the particular level is indicative of the temperature of the evaporator during such time.

After a delay of 30 seconds, a block 80 again senses the temperature of the evaporator 22 by determining the time $t_2$ required to charge the capacitor C1 to the particular level.

The blocks 76 and 80 together comprise means for periodically sensing the evaporator temperature during a defrost cycle. The temperatures that are sensed by the blocks 76, 80 at first and second points in time during a defrosting cycle are used to determine the rate of change of evaporator temperature.

Following the block 80, control passes to a block 82 which determines whether the flag X has been reset to zero. If this is the first pass through the program, then the flag X has in fact been reset and control passes to a block 84 which checks to determine whether the charge time $t_1$ is greater than the charge time $t_2$. In effect, the block 84 compares the charge times $t_1$ and $t_2$ to determine whether the rate of change of evaporator temperature is a positive value, indicating that the evaporator temperature is rising. If this is the case as seen in the graph of FIG. 5 between the times A and B, control returns to the blocks 76–80 which determine two new charge times $t_1$ and $t_2$ that are indicative of the evaporator temperature at two subsequent points in time.

As seen in FIG. 5, the temperature of the evaporator will continue to increase between time A and time B, at which point the evaporator has been heated to 32° F. At or shortly subsequent to the time B, the block 84 determines that the charge time $t_1$ is not greater than the charge time $t_2$ and control passes to a block 86. This block sets the flag X by assigning a value of one to it to indicate that the rate of change of evaporator temperature is at substantially zero. A block 88 then starts a clock CLK to begin timing of the interval during which the rate of change of evaporator temperature is zero.

After a delay of two minutes interposed by a block 90, control returns to the blocks 76–80 which continue to determine new charge times $t_1$ and $t_2$. Further, due to the setting of the flag X by the block 86, control passes from the block 82 to a block 92 which checks to determine whether the charge times are equal. In the interval between the times B and C, this is the case, and hence control remains in the loop comprising the blocks 76–82 and 92 for this period of time.

At or shortly subsequent to the time C, the charge times $t_1$ and $t_2$ are no longer equal. Hence, control passes from the block 92 to a block 94 which stops the fusion time clock CLK. The clock CLK now stores a fusion time value $T_F$ which is the length of the interval between the times B and C shown in FIG. 5. This fusion time value $T_F$ is the length of time required to totally remove the frost load from the evaporator 22 not including the time required to heat the frost load in the interval of time between points A and B and is indicative of the magnitude of the frost load on the evaporator prior to the time B. This value $T_F$ is utilized by a block 96 to adjust the length of the next cooling cycle in a manner well known in the art.

For example, the block 96 varies the length of the next cooling cycle in accordance with the fusion time value $T_F$ determined during a defrostin cycle such that if the fusion time value is greater than a preselected desired defrost time, indicating that too great a frost load had built up on the evaporator, the length of the next cooling cycle is shortened to reduce the frost load to be removed in the next defrosting cycle. Conversely, if the time $T_F$ is less than the desired defrost time, the length of the next cooling cycle is increased so that a greater frost load accumulates on the evaporator before the next defrosting cycle.

In this fashion, the lengths of the cooling cycles and the defrosting cycles tend toward the desired defrost time which causes efficient operation of the refrigerator. For a more detailed description of a scheme for adjusting the next cooling cycle in response to the length of the defrost operations reference is made to U.S. Pat. No. 4,251,988 issued to Allard et al, which is hereby incorporated herein by reference.

Following the block 96, a block 98 terminates the defrosting cycle and initiates the next cooling cycle for the period of time determined by the block 96. The blocks 92–98, therefore, together comprise means for sensing when the frost is removed from the evaporator and means for de-energizing the defrosting apparatus when the frost is removed. The removal of the frost load is in turn sensed by determining when the rate of change of the evaporator temperature rises above a certain value. The block 98 cycles the cooling means on and off during the next cooling cycle in accordance with the set point established by a user by means of the potentiometer R3. In general, when the temperature in the refrigerator compartment 18 or 20 as sensed by the thermistor 46 exceeds the user-selected set point, a high state signal is developed at the output of the op amp A2 which in turn causes the microcomputer 42 to turn on the transistor Q1 and turn off the transistor Q2 if it is on. This energizes the compressor 24 to cool the refrigerated compartment and de-energize the defrost heater if it is energized.

Similarly, when the temperature of the compartment 18 or 20 falls below a preselected value, a low state signal is developed by the op amp A2 which in turn causes the microcomputer to de-energize the transistor Q1 to turn the compressor off.

It should be noted that the resistor R7 provides a limited amount of hysteresis to prevent rapid fluctuations in the output of the op amp A2 when the sensed temperature in the compartment 18 or 20 is close to the user-selected set point.

Following the block 98, control returns to the block 70, after which a new defrosting cycle is begun. Referring now to FIG. 4, there is illustrated in greater detail the programming of the blocks 76 and 80 shown in FIG. 3*a*.

Following the blocks 74 or 78, FIG. 3*a*, control passes to a block 100 which discharges the capacitor C1 by generating a low state signal at the output $O_1$ of the microcomputer 42, FIG. 2. Control then passes to a block 102 which generates a high state signal at the output $O_1$. This block comprises charging means for charging the capacitor C1 through the thermistor 30. A block 104 starts a timer CHGTM in the microcomputer 42 when output $O_1$ is set to a high state to measure the length of time required to charge the capacitor C1 to the predetermined level.

Following the block 104, a block 106 continually checks to determine when the output of the op amp A1 switches states. Once this occurs, the timer CHGTM is stopped by a block 108 and the accumulated value $t_n$ (i.e. either the value $t_1$ or $t_2$) is stored in a register in the microcomputer 42 by a block 110.

As noted previously, the charge times $t_1$ and $t_2$ are used to determine the rate of change of temperature of the evaporator to in turn determine the length of the next cooling cycle.

The length of time between the points B and C in the graph of FIG. 5 provides a true measure of the magnitude of the frost load on the evaporator and hence can be used to more accurately estimate the desired length of the next cooling cycle for efficient operation of the refrigerator. Further, this duration is detected in a simple and inexpensive manner using a small number of components.

It should be noted that the length of the interval between the points B and C can be sensed by alternative means, for example, by accumulating clock pulses in a counter while the temperature of the evaporator is within predetermined limits, such as 30° F. to 34° F. However, it is more desirable to sense the change in temperature rather than the absolute temperature since close temperature sensing accuracy is required for the latter whereas such accuracy is not required for the former.

We claim:

1. A control for a refrigeration device having cooling apparatus including an evaporator, defrosting apparatus for removing frost from the evaporator and means for energizing the defrosting apparatus at the end of a cooling cycle to initiate a defrost cycle, comprising:

detecting means for detecting the rate of change of evaporator temperature during a defrosting cycle;

determining means for determining the length of time the rate of change of evaporator temperature remains at substantially zero; and establishing means for establishing the duration of a subsequent cooling cycle in dependence upon the determined length of time.

2. The control of claim 1, further including means for sensing when the frost is removed from the evaporator and means responsive to the sensing means for de-energizing the defrosting apparatus when the frost is removed.

3. The control of claim 2, wherein the sensing means comprises means coupled to the detecting means for determining when the rate of change of evaporator temperature rises above a certain value.

4. The control of claim 1, wherein the detecting means includes evaporator temperature sensing means for sensing the evaporator temperature at first and second times and means for comparing the sensed temperatures to detect the rate of change.

5. The control of claim 4, wherein the evaporator temperature sensing means includes a thermistor in heat-transfer association with the evaporator, a capacitor coupled in series with the thermistor, means for charging the capacitor through the thermistor, means for starting the charging means at the first and second times, respectively, and means for measuring the length of time required to charge the capacitor to a certain level.

6. A control for a refrigeration device having cooling apparatus including an evaporator, defrosting apparatus for removing frost from the evaporator and means for energizing the defrosting apparatus at the end of a cooling cycle to initiate a defrost cycle, comprising detecting means for detecting the rate of change of temperature of the evaporator during a defrost cycle;

determining means coupled to the detecting means for determining the length of time the rate of change of temperature is substantially zero during the defrost cycle;

de-energizing means for de-energizing the defrosting apparatus once the frost has been removed from the evaporator; and means coupled to the determining means for adjusting the duration of the next cooling cycle in dependence upon the determined length of time.

7. The control of claim 6, wherein the de-energizing means includes means for sensing when the rate of change of temperature exceeds a predetermined value.

8. The control of claim 6, wherein the detecting means includes evaporator temperature sensing means for sensing the evaporator temperature at first and second times and means for comparing the sensed temperatures to detect the rate of change.

9. The control of claim 8, wherein the evaporator temperature sensing means includes a thermistor in heat-transfer association with the evaporator, a capacitor coupled in series with the thermistor, means for charging the capacitor through the thermistor, means for starting the charging means at the first and second times, respectively, and means for measuring the length of time required to charge the capacitor to a certain level.

10. A control for a refrigerator having cooling apparatus for cooling a compartment including an evaporator, defrosting apparatus for removing frost from the evaporator and means for energizing the defrosting apparatus at the end of a cooling cycle to initiate a defrosting cycle, comprising:

periodic sensing means for periodically sensing the evaporator temperature during a defrosting cycle;

comparing means responsive to the periodic sensing means for comparing successive sensed temperatures for deciding the rate of change of evaporator temperature;

determining means responsive to the comparing means for determining the length of time the rate of change of evaporator temperature is substantially zero;

means for de-energizing the defrosting apparatus when the frost on the evaporator has been removed; and means responsive to the determining means for establishing the length of the next cooling cycle in dependence upon the determined length of time the rate of change of evaporator temperature was substantially zero in the defrosting cycle.

11. The control of claim 10, wherein the periodic sensing means comprises a thermistor in heat-transfer association with the evaporator, a capacitor coupled in series with the thermistor and means for charging the capacitor through the thermistor.

12. The control of claim 11, wherein the periodic sensing means further comprises means for measuring the length of time required to charge the capacitor to a certain level to thereby derive an indication of the evaporator temperature.

13. The control of claim 10, wherein the de-energizing means includes means for sensing when the rate of change of temperature exceeds a predetermined value.

14. The control of claim 10, wherein the periodic sensing means includes means for sensing the evaporator temperature at first and second times and said comparing means includes means for comparing the sensed temperatures to detect the rate of change.

15. The control of claim 10, wherein said periodic sensing means includes a thermistor in heat-transfer association with the evaporator, a capacitor coupled in series with the thermistor, means for charging the capacitor through the thermistor at evenly spaced intervals and means for measuring the length of time required to charge the capacitor to a certain level and wherein said comparing means includes means for deciding whether a successive evaporator temperature value is equal to the preceding evaporator temperature value.

* * * * *